US011021920B2

(12) United States Patent
Foucher et al.

(10) Patent No.: US 11,021,920 B2
(45) **Date of Patent: *Jun. 1, 2021**

(54) DOWNHOLE TOOLS AND METHODS OF CONTROLLING DOWNHOLE TOOLS

(71) Applicant: Schlumberger Technology Corporation, Sugar Land, TX (US)

(72) Inventors: Pierre-arnaud Foucher, Houston, TX (US); Todor K. Sheiretov, Houston, TX (US); Gregory J. Giem, Houston, TX (US); Lucas Teurlay, Houston, TX (US); Quentin Smith, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/425,577

(22) Filed: May 29, 2019

(65) Prior Publication Data

US 2019/0277102 A1 Sep. 12, 2019

Related U.S. Application Data

(63) Continuation of application No. 15/840,051, filed on Dec. 13, 2017, now abandoned, which is a continuation of application No. 14/677,848, filed on Apr. 2, 2015, now Pat. No. 9,850,724.

(51) Int. Cl.

| | |
|---|---|
| ***E21B 23/00*** | (2006.01) |
| ***E21B 23/01*** | (2006.01) |
| ***E21B 23/04*** | (2006.01) |
| ***E21B 17/10*** | (2006.01) |

(52) U.S. Cl.

CPC ..... *E21B 23/00* (2013.01); *E21B 17/1021* (2013.01); *E21B 23/01* (2013.01); *E21B 23/04* (2013.01); *E21B 23/001* (2020.05)

(58) Field of Classification Search

CPC ..... E21B 17/1021; E21B 2023/008; E21B 23/00; E21B 23/01; E21B 23/04

See application file for complete search history.

(56) References Cited

U.S. PATENT DOCUMENTS

| | | | | |
|---|---|---|---|---|
| 3,685,158 A | | 8/1972 | Planche | |
| 4,573,537 A | | 3/1986 | Hirasuna et al. | |
| 5,092,423 A | * | 3/1992 | Petermann | E21B 17/1021 181/102 |
| 6,273,189 B1 | | 8/2001 | Gissler | |

(Continued)

FOREIGN PATENT DOCUMENTS

| | | | | |
|---|---|---|---|---|
| GB | 2251014 A | * | 6/1992 | E21B 47/01 |
| GB | 2251014 A | | 6/1992 | |

*Primary Examiner* — James G Sayre

(74) *Attorney, Agent, or Firm* — Eileen Pape

(57) ABSTRACT

A downhole tool that has a plurality of arm assemblies. Each of the arm assemblies has an arm configured to expand and retract and an actuator. A hydraulic bus in fluid communication with the plurality of arm assemblies. A plurality of flow control devices. The flow control devices are configured to selectively isolate one or more arm assemblies of the plurality of arm assemblies from the hydraulic bus while maintaining the other arm assemblies of the plurality of arm assemblies in communication with the hydraulic bus.

19 Claims, 5 Drawing Sheets

(56) References Cited

U.S. PATENT DOCUMENTS

| | | | | |
|---|---|---|---|---|
| 6,345,669 | B1 | 2/2002 | Buyers et al. | |
| 6,920,936 | B2 | 7/2005 | Shieretov et al. | |
| 7,334,642 | B2 | 2/2008 | Doering et al. | |
| 7,392,859 | B2 | 7/2008 | Mock et al. | |
| 7,607,497 | B2 | 10/2009 | Mock et al. | |
| 7,624,808 | B2 | 12/2009 | Mock | |
| 7,770,667 | B2 | 8/2010 | Moore | |
| 7,886,834 | B2 | 2/2011 | Spencer et al. | |
| 7,954,562 | B2 | 6/2011 | Mock | |
| 8,028,766 | B2 | 10/2011 | Moore | |
| 8,061,447 | B2 | 11/2011 | Krueger | |
| 9,850,724 | B2 * | 12/2017 | Foucher | E21B 23/00 |
| 2011/0048801 | A1 | 3/2011 | Jacob | |
| 2014/0014368 | A1 | 1/2014 | Hullundbaek | |
| 2015/0167416 | A1 | 6/2015 | Ludwig | |
| 2016/0290047 | A1 | 10/2016 | Foucher | |

* cited by examiner

DOWNHOLE TOOLS AND METHODS OF CONTROLLING DOWNHOLE TOOLS

CROSS-REFERENCE TO RELATED APPLICATIONS

This application is a continuation of U.S. Non-Provisional patent application Ser. No. 15/840,051, filed Dec. 13, 2017, which is a continuation of U.S. Non-Provisional patent application Ser. No. 14/677,848, filed Apr. 2, 2015, the disclosures of which are incorporated by reference herein in their entireties for all purposes.

FIELD OF THE DISCLOSURE

The disclosure generally relates to downhole tools and methods of controlling downhole tools.

BACKGROUND

Downhole tools, such as tractors, often need to negotiate obstacles in wellbores. However, individual control of arms of traditional tractors is not possible; thereby, hindering the ability of traditional tractors to negotiate restrictions in the wellbore or isolate a failed motor.

SUMMARY

An embodiment of a downhole tool may include a plurality of arm assemblies. Each of the arm assemblies can include an arm configured to expand and retract and an actuator. The downhole tool may also include a hydraulic bus. The hydraulic bus may be in fluid communication with the plurality of arm assemblies; and a plurality of flow control devices. The flow control devices can be configured to selectively isolate individual arm assemblies of the plurality of arm assemblies from the hydraulic bus.

Another embodiment of the downhole tool may include a plurality of arm assemblies, and each of the arm assemblies may include an arm configured to expand and retract and an actuator. The plurality of arm assemblies can be in fluid communication with a hydraulic bus. The downhole tool may also include a plurality of flow control devices; and the flow control devices can be configured to selectively isolate individual arm assemblies of the plurality of arm assemblies from the hydraulic bus. The downhole tool can also include a control module in communication with the plurality of flow control devices, and a sensor can be in communication with the control module.

An example method of controlling arm activation of a downhole tool can include providing fluid to a hydraulic bus in fluid communication with a plurality of arm assemblies; and isolating individual arm assemblies of the plurality of arm assemblies from the hydraulic bus.

DETAILED DESCRIPTION OF THE INVENTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

An embodiment of a downhole tool includes a plurality of arm assemblies. The arm assemblies include an arm configured to expand and retract and an actuator. The example downhole tool also includes a hydraulic bus in fluid communication with the plurality of arm assemblies; and a plurality of flow control devices. The flow control devices are configured to selectively isolate individual arm assemblies of the plurality of arm assemblies from the hydraulic bus.

An embodiment of a downhole tool can also include a control module in communication with the plurality of flow control devices and at least one sensor. The sensor can be a caliper located on the downhole tool below a drive section, and the control module can receive wellbore diameter data from the caliper and selectively isolate individual arm assemblies of the plurality of arm assemblies according to the wellbore diameter data. The control module can be a microprocessor configured to receive the wellbore data and control the plurality of flow control devices to selectively isolate individual arm assemblies, allowing selective closure of the arm assemblies according to the wellbore diameter data. The control module can also receive feedback from motors associated with the arm assemblies and control the plurality of flow control devices to isolate arm assemblies associated with a failed motor from the hydraulic bus.

Figure 1:
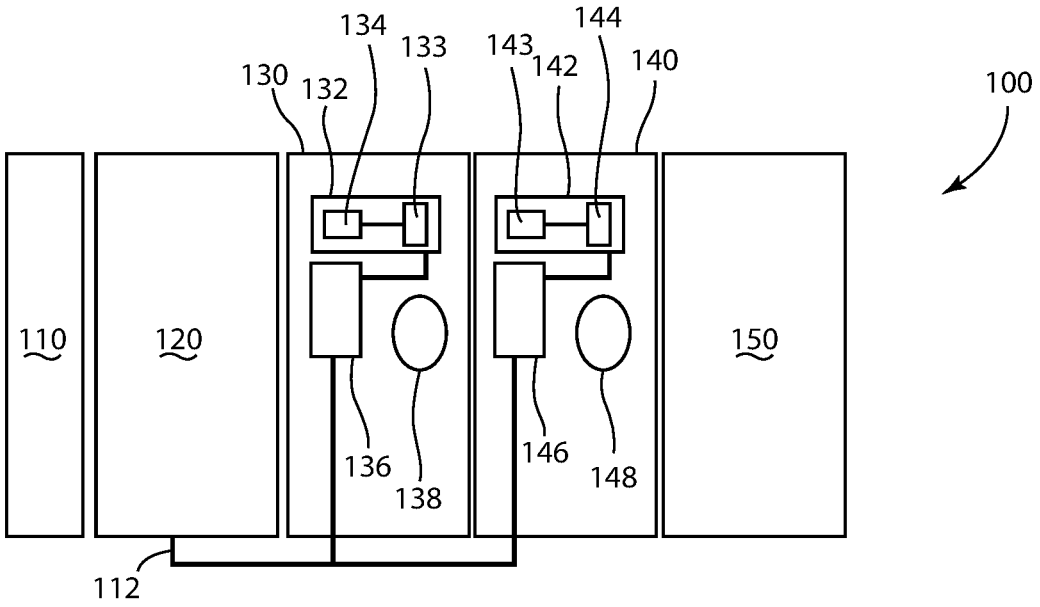
FIG. 1 depicts a schematic of an embodiment of the downhole tool.

FIG. 1 depicts a schematic of an embodiment of a downhole tool. The downhole tool 100 can contain a control module 110, a hydraulic module 120, a first drive module 130, a second drive module 140, and a sensor 150.

The control module 110 can contain one or more microprocessors configured to control components of the tool. For example, one microprocessor can control a pump in the hydraulic module 120, a second microprocessor can control flow control devices 136 and 146, and a third microprocessor can control motors 138 and 148. Of course, each motor can be controlled by two independent microprocessors. Two microprocessors can also control the flow control devices. Other now known or future known configurations and methods of controlling the components of the downhole tool 100 can also be used.

The hydraulic module 120 can include a hydraulic system including a pump, motor, valves, and flow lines. Any now known or future known hydraulic systems can be used.

The flow control devices 136 and 146 can be any adjustable flow control device. The flow control devices can be solenoid valves.

The sensor module 150 can be a caliper or other sensor configured to acquire downhole data. The downhole data can include wellbore diameter, temperature, pressure, downhole tool velocity, or combinations thereof.

The hydraulic module 120 can provide pressurized fluid to the drive modules 130 and 140 via hydraulic bus 112.

The first drive module 130 can include the first flow control device 136, the first motor 138, and a first arm assembly 132. The first arm assembly 132 can include an actuator 133 and a first arm 134.

The second drive module 140 can include the second flow control device 146, a second arm assembly 142, and the second motor 148. The second arm assembly 142 can include a second actuator 143 connected with a second arm 144.

The actuators 133 and 143 can be any now known or future known activation device. An illustrative actuator is hydraulically operated, and as a piston is moved the connected arm is radially expanded. The arms 134 and 144 can be connected with the actuators 133 and 143 using any now known or future known techniques. The arms 134 and 144 can have a wheel, roller, or the like on an end thereof. The wheel, roller, or the like can be driven by the first motor 138 to provide movement to the downhole tool.

The first flow control device 136 can be selectively controlled to allow fluid communication of a first arm activation assembly 132 with the hydraulic bus 112, and the second flow control device 146 can be selectively controlled to allow fluid communication between the second arm activation assembly 142 and the hydraulic bus 112. For example, if the control module determines that the first motor 138 has stopped working, the control module 110 can close the first flow control device; thereby, preventing communication between the hydraulic bus 112 and the first arm activation device 133. Accordingly, the first arm activation assembly 133 will not radially expand the first arm 134, and the second arm 144 can remain radially expanded.

In another example, the sensor module 150 can determine that there is a reduction in the wellbore, the speed of the downhole tool can be determined using now known techniques or future known techniques, and distance of each drive module 130 and 142 can be known. The control module 150 can use these parameters to determine that there is an obstruction and if the arms of the drive module need to be retraced and when the first arm 134 and the second arm 144 need to be retracted. To allow retraction of the arms 134 and 144, the control module 110 can selectively close the flow control devices 136 and 146 respectively.

Figure 2:
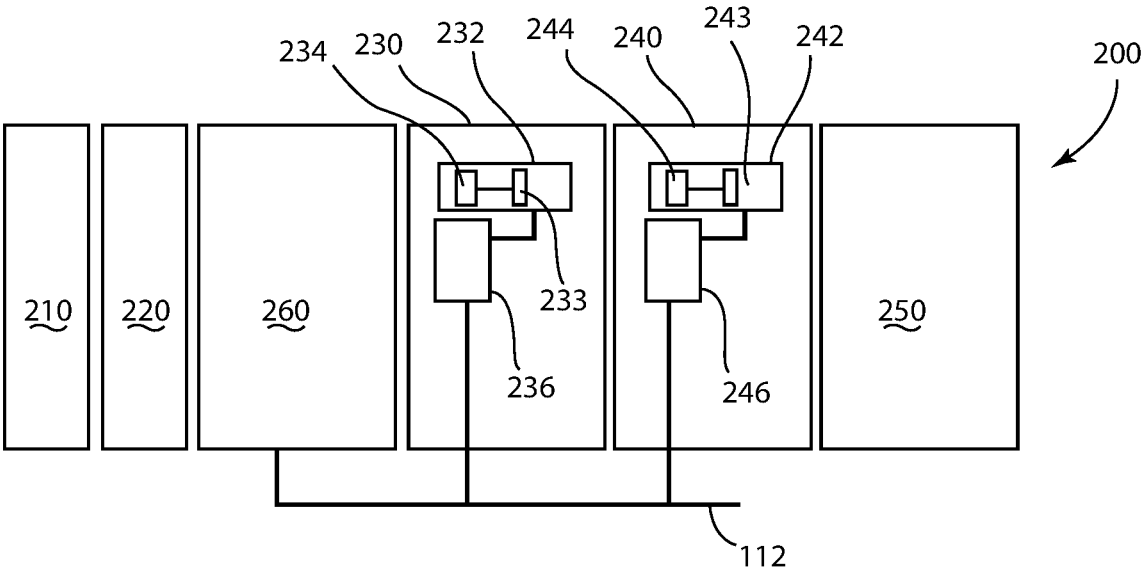
FIG. 2 depicts a schematic of another embodiment of a downhole tool.

FIG. 2 depicts a schematic of another embodiment of a downhole tool. The downhole tool 200 can include a control module 210, a sensor module 250, a first drive module 230, a second drive module 240, a hydraulic bus 112, a hydraulic module 220, and a motor module 260.

The control module 210 can include one or more microprocessors and other equipment allowing the control module 210 to control the components of the downhole tool 200.

The motor module 260 can be operatively connected with the drive modules 230 and 240, allowing the motor module 260 to provide power to both drive modules 230 and 240. The motor module 260 can be connected with the drive modules 230 and 240 using a drive shaft, gear box, continuous variable transmission, other now known or future known drive components, or combinations thereof.

The first drive module 230 can include a first flow control device 236 and a first arm assembly 232. The first arm assembly 232 can include an actuator 233 and a first arm 234.

The second drive module 240 can include a second flow control device 246 and second arm assembly 242. The second arm assembly 242 can include a second actuator 243 connected with a second arm 244.

The actuators 233 and 243 can be any now known or future known activation device. An illustrative actuator is hydraulically operated, and as a piston is moved the connected arm is radially expanded. The arms 234 and 244 can be connected with the actuators 233 and 243 using any now known or future known techniques. The arms 234 and 244 can have a wheel, roller, or the like on an end thereof. The wheel, roller, or the like can be driven by the motor module 260 to provide movement to the downhole tool.

The sensor module 250 can be a caliper or other sensor configured to acquire downhole data. The downhole data can include wellbore diameter, temperature, pressure, downhole tool velocity, or combinations thereof.

Figure 3:
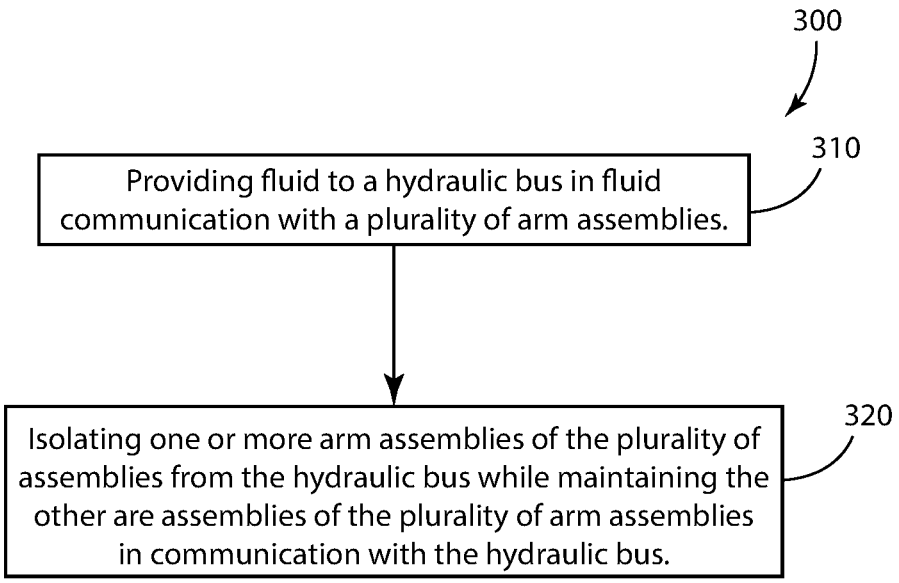
FIG. 3 depicts a flow diagram of an example method of controlling arm activation of a downhole tool.

FIG. 3 depicts a flow diagram of an example method of controlling arm activation of a downhole tool. The method 300 can include providing fluid to a hydraulic bus in fluid communication with a plurality of arm assemblies (Block 310). The method 300 can also include isolating one or more arm assemblies from the plurality of arm assemblies from the hydraulic bus while maintaining the other arm assemblies of the plurality of arm assemblies in communication with the hydraulic bus (Block 320). Isolating can include closing one or more flow control devices. The one or more arm assemblies of the plurality of arm assemblies can be isolated from the hydraulic bus in response to data acquired by a sensor in communication with a control module.

In one or more embodiments each of the arm assemblies of the plurality of arm assemblies can include a constant force actuator. The constant force actuator disclosed herein can be used with other downhole tools as well. For example, the constant force actuator can be used to expand a centralizer, a caliper, an anchor, or other radially expanding components of a downhole tool.

Figure 4:
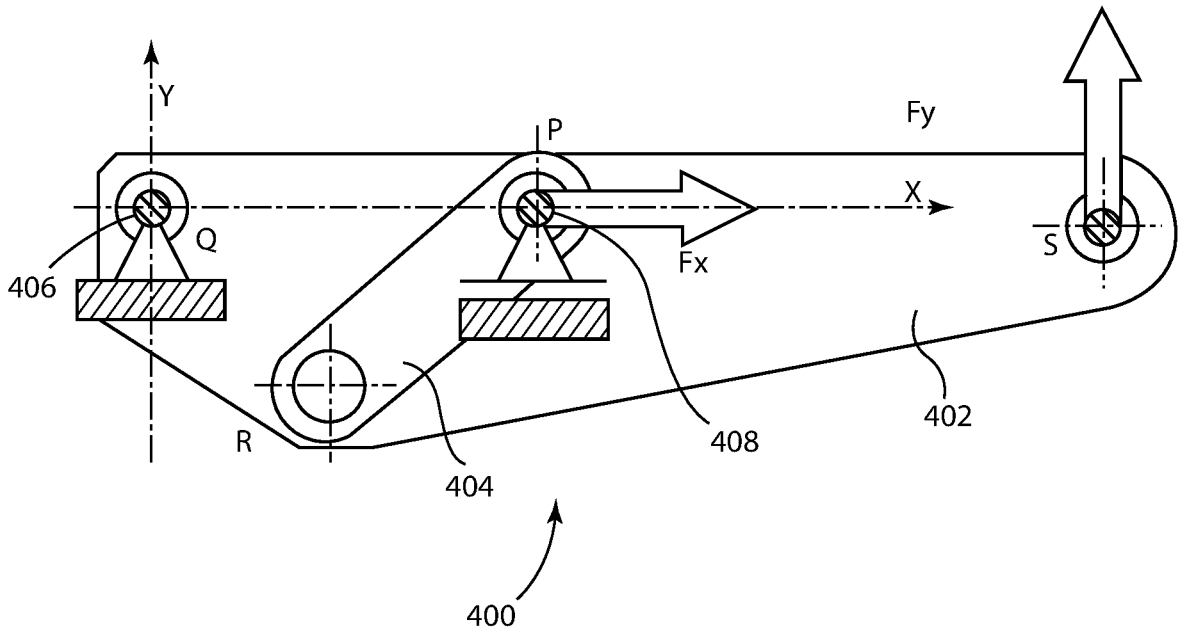
FIG. 4 depicts a schematic of an example constant force actuator in a closed position.
Figure 5:
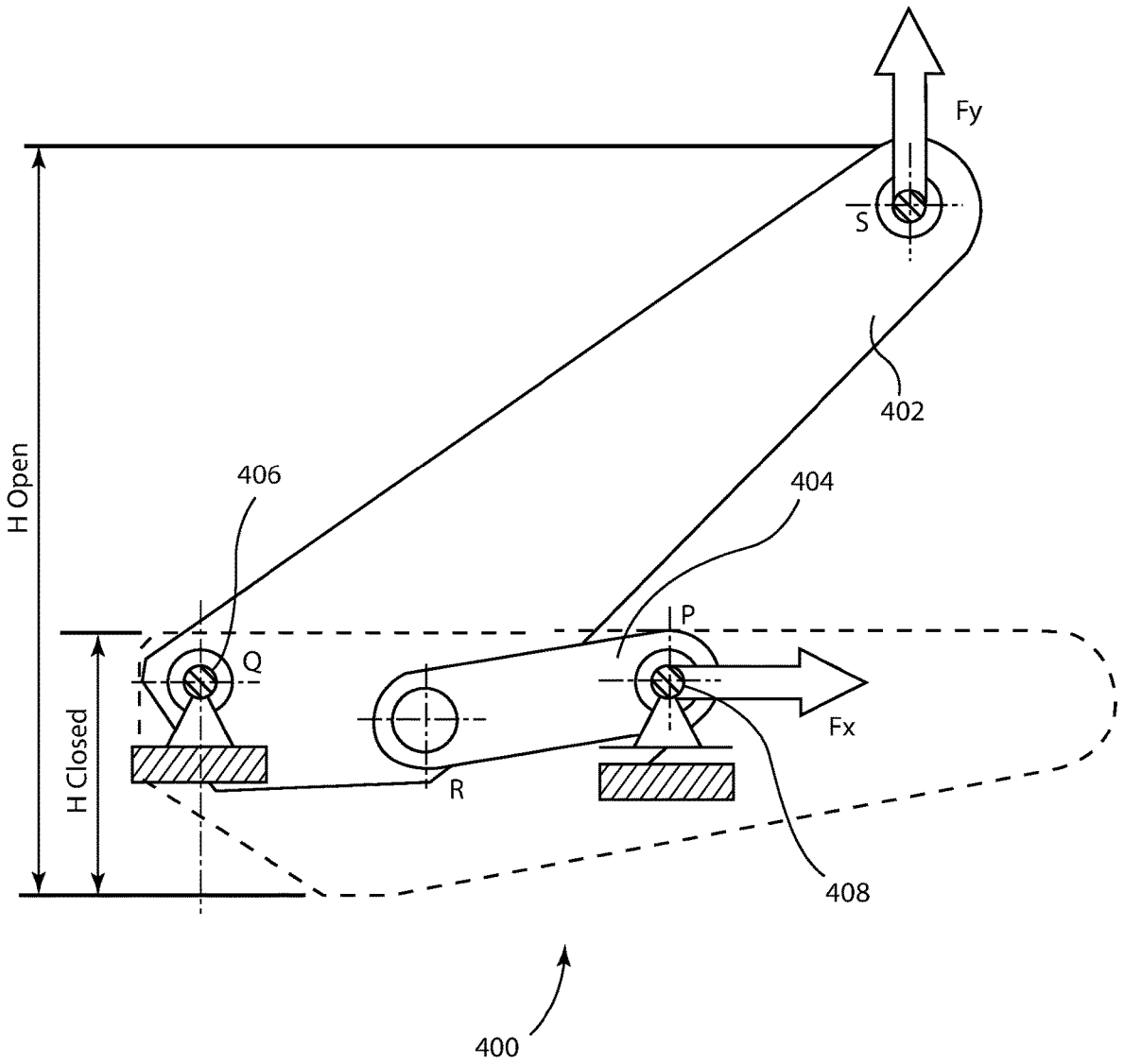
FIG. 5 depicts a schematic of the example constant force actuator of FIG. 4 in an open position.

FIG. 4 depicts a schematic of an example constant force actuator in a closed position. FIG. 5 depicts a schematic of the example constant force actuator of FIG. 4 in an open position.

Referring now to FIG. 4 and FIG. 5, the constant force actuator 400 includes a fixed support 406, an arm 402, a link 404, and a slide 408. The constant force actuator 400 has a closed height, represented as Hclosed, and an open height, represented as Hopen. The actuator 400 can be moved from the closed position by applying an axial force, represented as Fx, to the slider 408. The slide 408 will move the link 404, causing the arm 402 to pivot about a connection on the fixed support 406. The pivoting will continue until the arm contacts a borehole wall or other obstruction, and then a radial force, represented as Fy, will be exerted on the borehole wall or other obstruction at a point S.

The constant force actuator 400 can have a force ratio of Radial Force=Fy/Fx. The constant force actuator 400 can have an expansion ratio as Expansion Ratio=Hopen/Hclosed. The constant force actuator can have a constant radial force for any position of the slider 408 within the range defined by Hopen and Hclosed.

Figure 6:
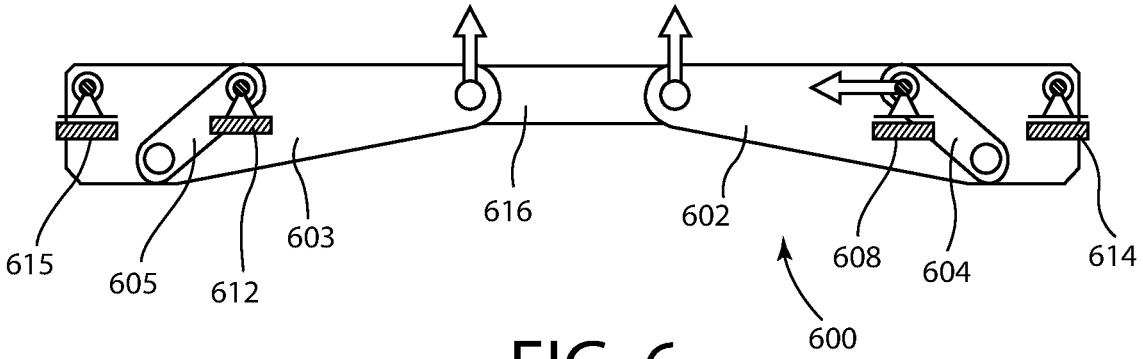
FIG. 6 depicts a schematic of another example constant force actuator in a closed position.
Figure 7:
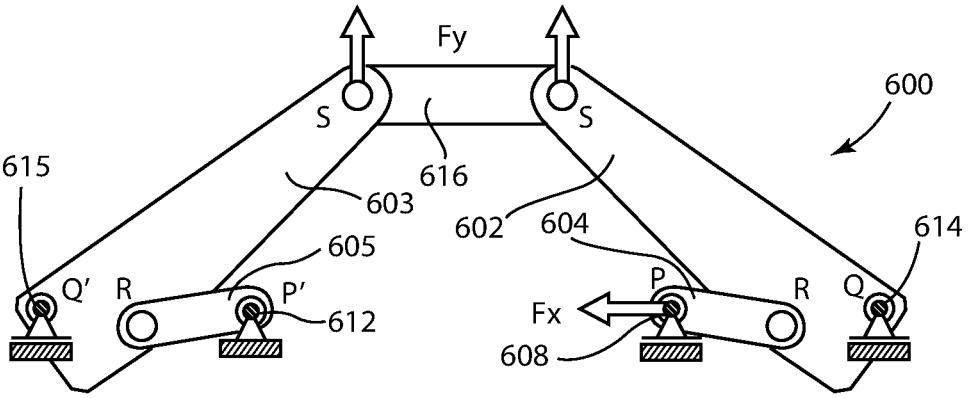
FIG. 7 depicts a schematic of the constant force actuator in FIG. 6 in a partially radially expanded state.
Figure 8:
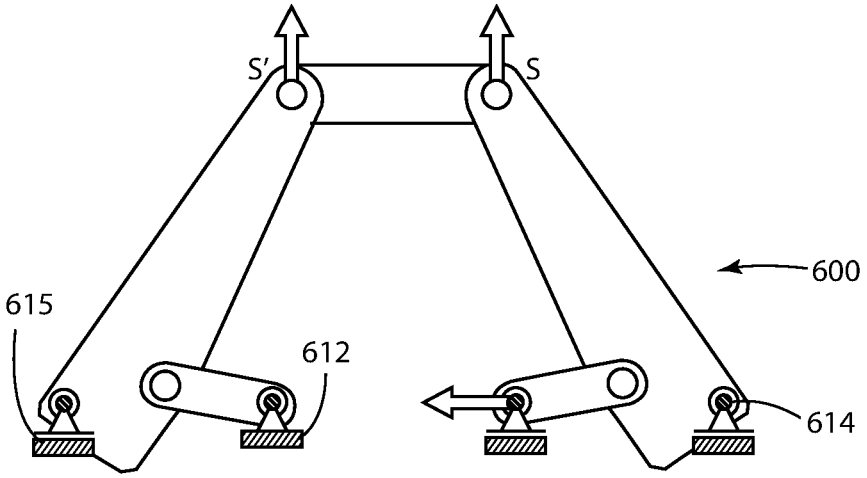
FIG. 8 depicts a schematic of the constant force actuator of FIG. 6 in a fully radially expanded state.

FIG. 6 depicts a schematic of another example constant force actuator in a closed position. FIG. 7 depicts a schematic of the constant force actuator in FIG. 6 in a partially radially expanded state. FIG. 8 depicts a schematic of the constant force actuator of FIG. 6 in a fully radially expanded state.

Referring now to FIG. 6, FIG. 7, and FIG. 8, the constant force actuator 600 includes a first arm 602, a second arm 603, a first link 604, a second link 605, a fixed support 612, a slider 608, a first moveable support 614, a second movable support 615, and a bar 616. In one or more embodiments, the bar 616 can be omitted.

The slider 608 can have an axial force, designated as Fx, applied thereto, and as the slider 608 moves in the direction of the axial force Fx, the distance between point P and point P' is decreased and the arms 602 and 603 can expand radially. The movable support 614 and 615 allow the pivots Q and Q' connected with the arms 602 and 603, respectively, to translate axially. The arms 602 and 603 can radially expand until coming into contact with a borehole wall or other obstruction. Upon contacting the borehole wall or other obstruction, a radial force, designated as Fy, can be applied to the borehole wall or other obstruction. The radial force Fy will be applied at points S and S'. In one or more embodiments, the constant force actuator 600 can be used as a centralizer or anchor. In an embodiment where the constant force actuator 600 is used as an anchor, the radial force Fy can be used to secure a downhole tool within the borehole. The constant force actuator 600 can have an expansion ratio from about 3:1 to about 7:1, and the consistency of the force ratio can be preserved throughout the expansion.

Figure 9:
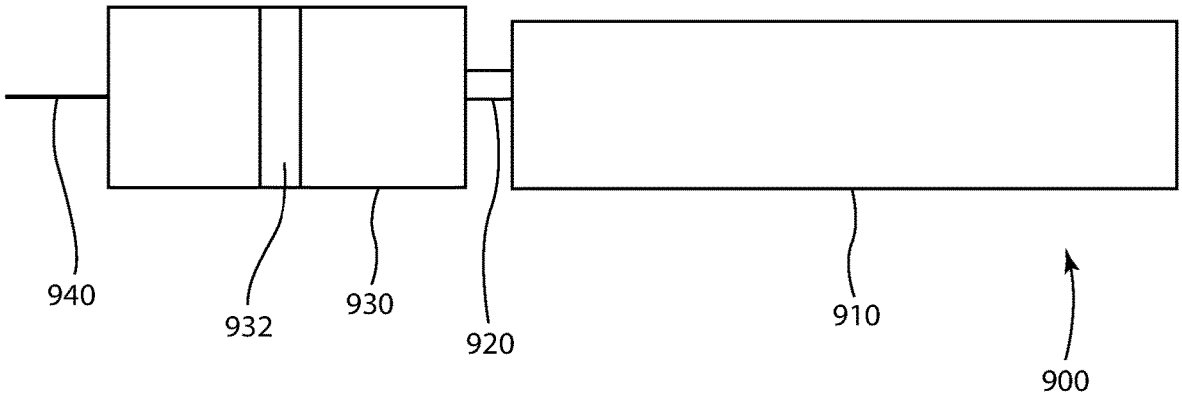
FIG. 9 depicts a schematic of an assembly including an anchor connected with a downhole tool.

FIG. 9 depicts a schematic of an assembly including an anchor connected with a downhole tool.

The system 900 can include a downhole tool 910, a field joint 920, an anchor module 930, a constant force actuator 932, and a conveyance 940.

The downhole tool 910 can be any one described herein, a milling tool, a shifting tool, the like, or a combination thereof. The constant force actuator 932 can be any one of those described herein. The constant force actuator 932 can have axial force applied thereto by an electric linear actuator, a motor, a hydraulic actuator, other now known or future known force generating devices, or combinations thereof.

The conveyance 940 can be a wireline, slickline, coil tubing, or the like.

The system 900 can be conveyed into a borehole, and upon reaching a desired location in the borehole, the constant force actuator 932 can be activated to anchor the system 900 in the borehole to allow a downhole operation to be performed. The constant force actuator 932 can be retracted upon completion of the downhole operation, the system 900 can be moved to perform another downhole operation or retrieved to the surface.

Although example assemblies, methods, systems have been described herein, the scope of coverage of this patent is not limited thereto. On the contrary, this patent covers every method, apparatus, and article of manufacture fairly falling within the scope of the appended claims either literally or under the doctrine of equivalents.

What is claimed is:

1. A downhole tool comprising:

a plurality of arm assemblies, wherein each arm assembly of the plurality of arm assemblies comprises:
- an arm configured to expand to an open position and retract to a closed position;
- a link coupled to the arm;
- a slider coupled to the link; and
- a fixed support coupled to the arm, where the arm is pivotally connected to the fixed support; and an actuator, wherein the arm assemblies are configured to be independently actuated;

wherein each arm assembly of the plurality of arm assemblies can be moved from the closed position to the open position via an axial force applied to the slider.

2. The downhole tool of claim 1, wherein the plurality of arm assemblies comprises a first arm assembly and a second arm assembly.

3. The downhole tool of claim 2, wherein the first arm assembly comprises a first arm and a first actuator, and wherein the second arm assembly comprises a second arm and a second actuator.

4. The downhole tool of claim 3, wherein a plurality of flow control devices comprises a first flow control device located between a hydraulic bus and the first actuator and a second flow control device located between the hydraulic bus and the second actuator.

5. The downhole tool of claim 4, further comprising a control module in communication with the plurality of flow control devices and at least one sensor.

6. The downhole tool of claim 1, further comprising a control module in communication with a plurality of flow control devices and at least one sensor, wherein the control module is configured to control the plurality of flow control devices to selectively isolate the plurality of arm assemblies from a hydraulic bus based on data acquired by the at least one sensor.

7. The downhole tool of claim 1, wherein each of the arm assemblies of the plurality of arm assemblies comprises a constant force actuator connected with the actuator.

8. The downhole tool of claim 7, wherein each constant force actuator has a constant radial force for any position of the slider while the arm moves between the open position and the closed position.

9. The downhole tool of claim 7, wherein each constant force actuator has an expansion ratio equal to an open height of the arm in the open position over a closed height of the arm in the closed position.

10. A method of controlling arm activation of a downhole tool, wherein the method comprises:

providing fluid to a hydraulic bus in fluid communication with a plurality of arm assemblies, wherein each arm assembly of the plurality of arm assemblies comprises:
- an arm configured to expand to an open position and retract to a closed position;
- a link coupled to the arm;
- a slider coupled to the link; and
- a fixed support coupled to the arm, where the arm is pivotally connected to the fixed support;

isolating one or more arm assemblies of the plurality of arm assemblies from the hydraulic bus while maintaining the other arm assemblies of the plurality of arm assemblies in communication with the hydraulic bus;

applying an axial force to the slider to move the slider in a direction of the applied axial force; and applying a radial force against an obstruction in contact with at least a point on the arm.

11. The method of claim 10, wherein isolating comprises closing one or more flow control devices.

12. The method of claim 10, wherein the one or more arm assemblies of the plurality of arm assemblies are isolated from the hydraulic bus in response to data acquired by a sensor in communication with a control module.

13. A downhole tool comprising:

a plurality of arm assemblies comprising a first arm assembly and a second arm assembly, wherein the first arm assembly comprises:
- a first arm configured to radially expand and retract;
- a first link coupled to the first arm;
- a slider coupled to the first link; and
- a first moveable support pivotally connected to the first arm;

and the second arm assembly comprises:

a second arm configured to radially expand and retract;

a second link coupled to the second arm;

a fixed support coupled to the second link, where the second arm is pivotally connected to the fixed support via the second link; and a second moveable support pivotally connected to the second arm;

an actuator;

a control module for selectively actuating the plurality of arm assemblies; and a sensor in communication with the control module.

14. The downhole tool of claim 13, wherein the first arm assembly further comprises a first actuator, and wherein the second arm assembly further comprises a second actuator.

15. The downhole tool of claim 14, wherein a plurality of flow control devices comprises a first flow control device located between a hydraulic bus and the first actuator and a second flow control device located between the hydraulic bus and the second actuator.

16. The downhole tool of claim 15, wherein each of the actuators is a constant force actuator.

17. The downhole tool of claim 16, wherein the constant force actuator comprises a bar connecting the first arm with the second arm.

18. The downhole tool of claim 16, wherein the constant force actuator is a centralizer, caliper, or anchor.

19. The downhole tool of claim 16, wherein the constant force actuator has an expansion ratio from 3:1 to 7:1.

* * * * *